US005353859A

United States Patent [19]

Oltahfer et al.

[11] Patent Number: 5,353,859

[45] Date of Patent: Oct. 11, 1994

[54] ROLLER DOOR APPARATUS

[75] Inventors: John Oltahfer; Glenn Nicol, both of Dickeyville, Wis.; David Noon, Dubuque, Iowa; David Leppert, Zwingle, Iowa; Mark Ungs, Dubuque, Iowa; Peter S. Schulte, East Dubuque, Ill.; Richard J. Dunkin, Dubuque, Iowa

[73] Assignee: Rite-Hite Corporation, Milwaukee, Wis.

[21] Appl. No.: 944,487

[22] Filed: Sep. 14, 1992

[51] Int. Cl.[5] ..... E06B 9/56

[52] U.S. Cl. ..... 160/310; 160/291

[58] Field of Search ..... 364/400; 160/1, 310, 160/133, 189, 191, 265; 318/266, 375; 242/55, 57

[56] References Cited

U.S. PATENT DOCUMENTS

| | | | |
|---|---|---|---|
| 4,507,594 | 3/1985 | Takemoto | 318/266 X |
| 4,757,853 | 7/1988 | Price | 160/191 |
| 4,770,065 | 9/1988 | Woyton . | |
| 4,990,837 | 2/1991 | Ishitobi | 318/375 |
| 5,198,974 | 3/1993 | Orsat | 160/133 |

*Primary Examiner*—Blair M. Johnson

*Attorney, Agent, or Firm*—Leydig, Voit & Mayer

[57] ABSTRACT

A roller door apparatus is provided that includes a roller means and a means journalling the roller means for reversible rotation about a central longitudinal roller axis. The roller door also includes end rail means for a reciprocal linear movement between a first position adjacent the roller means and a second position away from the roller means. Also included is a flexible curtain means with one end attached to the end rail means and the other end attached to the roller means, such that the curtain means closes a door opening with the end rail means in the second position. The curtain means winds onto the roller means when the end rail moves from the second position to the first position and vice versa. The roller door further includes a reversible electric drive motor means coupled to the roller means, and an electrical control means for controlling the drive means during movement of the end rail means for rapid acceleration of the curtain means during an initial portion of each movement, and for control of declaration of the curtain means to zero velocity during a final portion of each movement.

15 Claims, 5 Drawing Sheets

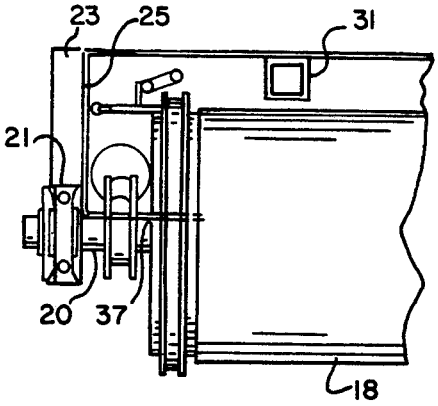
FIG. 3
FIG. 4
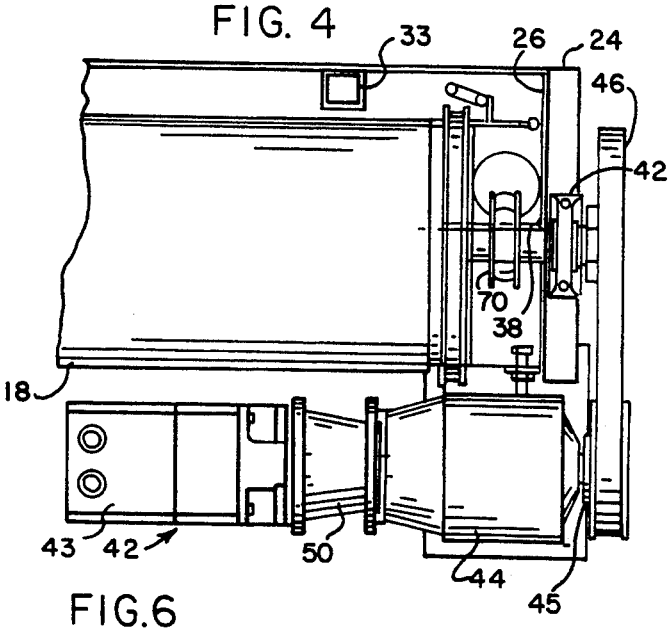
FIG. 5
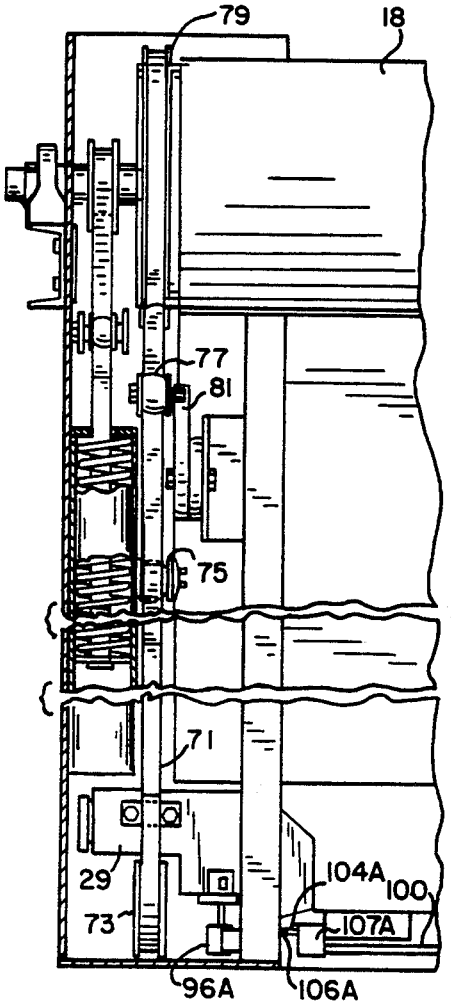
FIG. 6
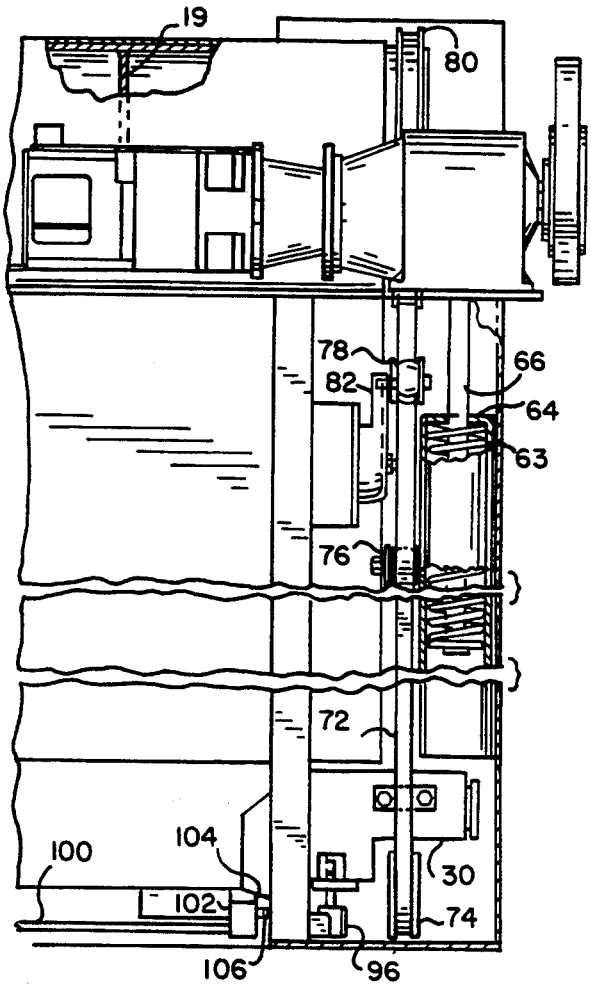

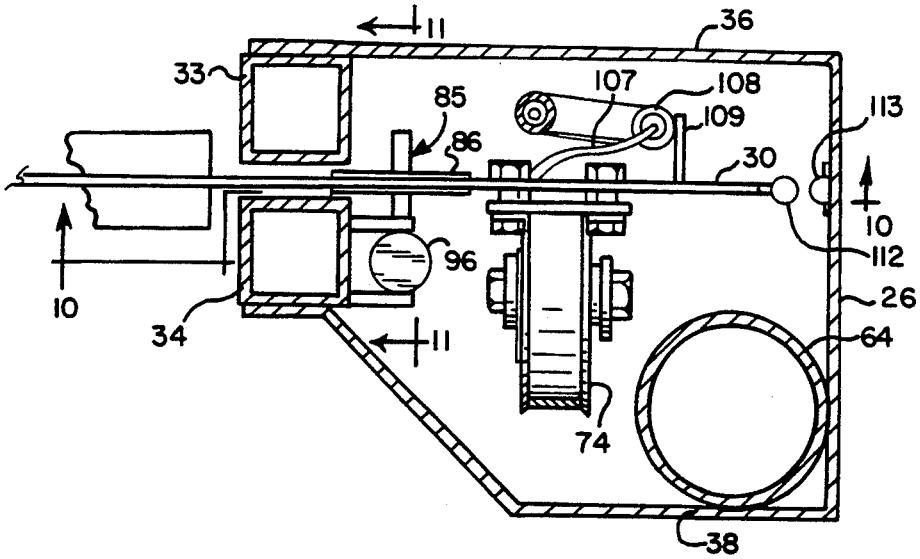
FIG.9
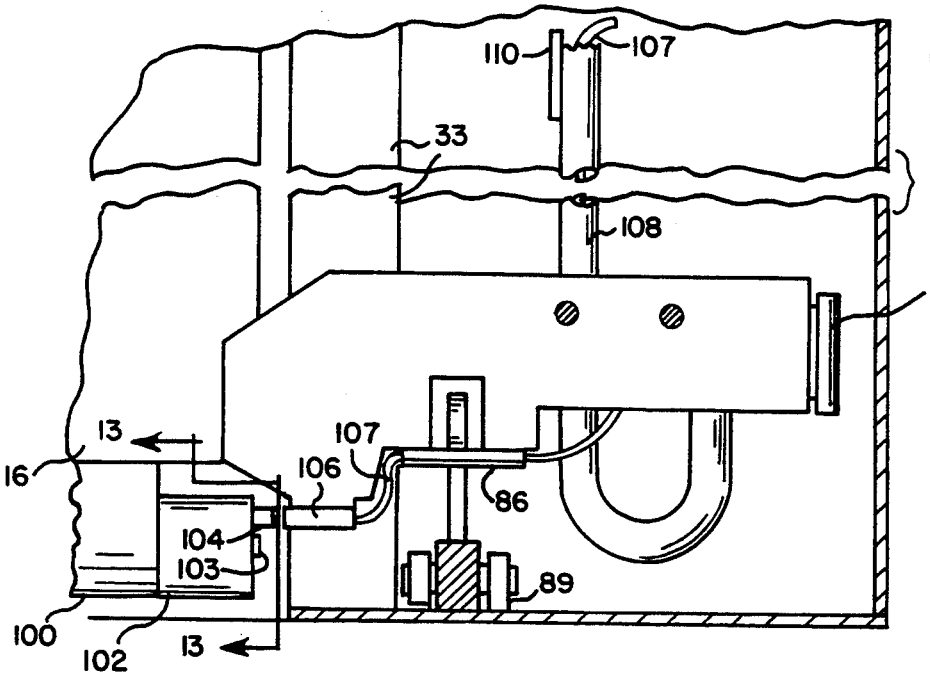
FIG.10
FIG.13
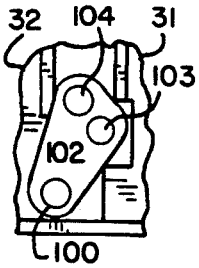
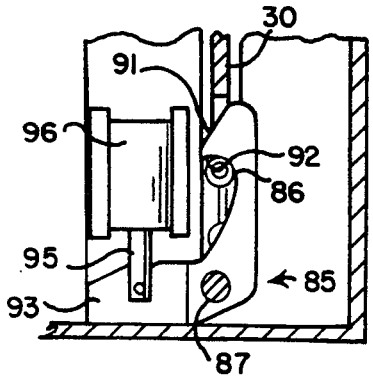
FIG.11
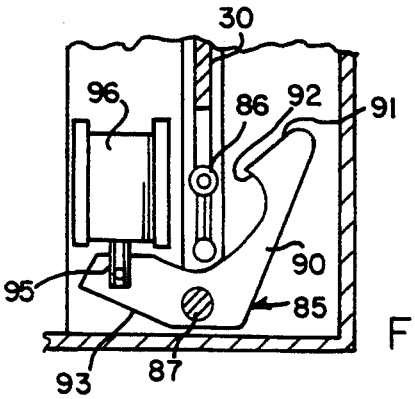
FIG. 12
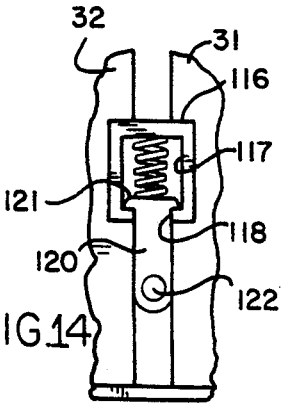
FIG14

ROLLER DOOR APPARATUS

COPYRIGHT AUTHORIZATION

A portion of the disclosure of this patent document contains material which is subject to copyright or mask work protection. The owner has no objection to the facsimile reproduction by anyone of the patent document or the patent disclosure, as it appears in the Patent and Trademark Office patent file or records, but otherwise reserves all copyright or mask work rights whatsoever.

BACKGROUND OF THE INVENTION

1. Field of the Invention

This invention relates to roller door apparatus and more particularly to a roller door apparatus in which a curtain is movable at a high velocity either to or from a closed position in which the curtain extends across a door opening with high tension. The apparatus avoids excessive stresses in the curtain and other components, is very safe and highly reliable in operation and is readily and economically manufacturable.

2. Background of the Prior Art

In a typical type of roller door construction of the prior art, a roller is supported in an elevated position over a door opening and a curtain is unwound from the roller and moved downwardly to a closed position covering the door opening, or is wound back up on the roller to an open position allowing passage through the door opening. To balance the torque applied to the roller from the forces of gravity acting on the curtain, a torsional counterbalance spring within the roller has been used in some constructions. In other constructions, a counterbalance weight has been connected to the roller. It is also known in the art that a tensioning force may be applied to a flexible curtain, using a flexible tensioning member connected to the lower end of the curtain and extending down around a guide pulley and thence upwardly to be wound up on a roller while a curtain is unwound from the roller, and vice versa.

To move a curtain between open and closed positions, hydraulic and electric motors have been controlled by proximity switches to come to a stop at limit positions of movement of the curtain.

These and other roller constructions of the prior art have been generally satisfactory, but have had limitations, particularly with respect to speed with which opening and closing operations are effected, and they have been subject to break-downs and have not otherwise been as reliable and durable as would be desired.

SUMMARY OF THE INVENTION

This invention was evolved with the general object of providing a improved roller door and more particularly to apparatus in which a curtain can be moved at high velocity and which is safe and reliable in operation with a long life, while being economically manufacturable.

Important aspects of the invention relate to the recognition and discovery of problems with prior art apparatus and their causes and to an analysis of what is necessary to overcome such problems and otherwise provide an improved roller door construction. In particular, it is recognized that problems with prior art apparatus have been the result of the lack of accurate control of drive systems, especially with respect to accurate control of stopping of the drive. For example, it has not been possible with drive systems of the prior art to operate at high speeds and, at the same time, bring the curtain to an accurate stop at a desired open or closed end position. Even at lower speeds there have been problems in this respect. In addition, the curtain and other components have been subjected to excessive stresses from stops which are too abrupt, especially when attempting to operate at high speeds, but at lower speeds as well. The result has been that curtains and other components have been subjected to excessive stresses and have failed in operation or have worn out more rapidly that would be desired.

In accordance with an important feature of the invention, a control system is provided for accurate control of an electric curtain-drive motor, operative to allow drive of the curtain at high speeds while allowing the curtain to be brought to a stop at either of two end positions with high accuracy and without producing excessive stresses in the curtain or other components. In accordance with a specific feature, the curtain support roller is driven by an electric motor of a type which can be controlled to obtain dynamic braking. Additional control is obtained by providing an electromechanical holding brake which may operate on the shaft of the motor. In a illustrated system of the invention, a servo drive system including a brushless DC servo motor and feedback circuitry is used in combination with an electrical control system. Approach signals are developed from sensors which sense the movement of the curtain through certain approach positions at which it is approaching the desired end positions of travel and the electrical control system responds to such approach signals to control initiation of dynamic braking and energization of the electromechanical holding brake at times such as to decelerate the curtain and bring it to a stop at each desired end position, without developing excessive stresses in the curtain or other components.

The apparatus of the invention has a number of features of construction which facilitate the achievement of a high speed of operation and provide other advantages. A specific feature relates to the use of a gear belt drive between the motor and the curtain support roller. It is found that the resiliency and damping characteristics inherently provided by a gear belt result in the absorbing of shocks which might otherwise be transmitted to the curtain if a chain or other more rigid coupling were provided.

The torque required for acceleration and deceleration of the roller and the curtain supported therefrom is minimized so as to allow use of a servo motor of low inertia. In an illustrated type of apparatus in which the curtain is moved vertically, a pair of counterbalancing assemblies are provided which include springs, the use of springs for counterbalance being in itself advantageous in minimizing inertia. Preferably, and in accordance with specific features, compression springs are used which are protectively enclosed in cylinders and which are connected to counterbalance belts wound on spools which are coupled to the roller. An arrangement is provided which is such as to obtain a very accurate counterbalance and in providing a high degree of safety and reliability.

A specific feature relates to the inclusion of an arrangement which facilitates more rapid accelerations and decelerations when using a servo motor. The arrangement includes a pair of control belts which act to insure rapid acceleration of a curtain during an initial portion of its downward movement and which also act to insure rapid deceleration of the curtain 11 during a final portion of its upward movement.

Another important feature of the invention relates to the application of tension to the curtain when in the closed condition. In accordance with this feature, a pair of solenoid-controlled latch mechanisms are provided at opposite ends of a rail provided at the end of the curtain, to latch the end rail against upward movement when in a position for closing a door opening. Then a drive motor is energized in a direction to develop a predetermined high tension in the curtain 11, to resist wind pressures and to minimize oscillatory flapping movements thereof. When it is desired to open the door opening, the servo motor is initially energized in an opposite direction, to reduce the tension in the curtain and then an electrical control system operates to release the latch mechanisms.

Further features relate to the incorporation of an obstruction detecting arrangement and to the protective enclosure of wiring connections for the obstruction detecting arrangement as well as for arrangement which detect passage of the curtain through certain positions.

Additional very important features relate to the provision of an electrical control system which is preferably implemented through the use of a programmable logic array and which has a number of features to contribute to obtaining a high speed of operation coupled with a high degree of safety and reliability. The system is versatile and capable of being programmed or adjusted in accordance with operating conditions or to meet the needs of a particular end user of the door apparatus. A specific feature is that it can be coupled to a computer either directly or through a telephone link and can also be coupled to a data highway of an automated plant. The status of the door can be readily monitored and servicing is facilitated.

This invention contemplates other objects, features and advantages which will become more fully apparent from the following detailed description taken in conjunction with the accompanying drawings.

BRIEF DESCRIPTION OF THE DRAWINGS

FIG. 3 is a sectional view taken substantially along line 3—3 of FIG. 2, with certain portions broken away;

FIG. 4 is a sectional view taken substantially along line 4—4 FIG. 2, with certain portions broken away;

FIG. 5 is an elevational sectional view taken substantially along line 5—5 of FIG. 1, with certain portions broken away;

FIG. 6 is an elevational sectional view taken substantially along line 6—6 of FIG. 1, with certain portions broken away;

FIG. 9 is a sectional view taken substantially along line 9—9 of FIG. 2;

FIG. 10 is a sectional view taken substantially along line 10—10 of FIG. 9;

FIG. 11 is a sectional view taken substantially along line 11—11 of FIG. 9;

FIG. 12 is a sectional view similar to FIG. 11, but showing parts in a different position;

FIG. 13 is a sectional view taken substantially along line 13—13 of FIG. 10;

FIG. 14 is a view similar to FIG. 13 but illustrating a modified construction.

DESCRIPTION OF PREFERRED EMBODIMENTS

Figure 1:
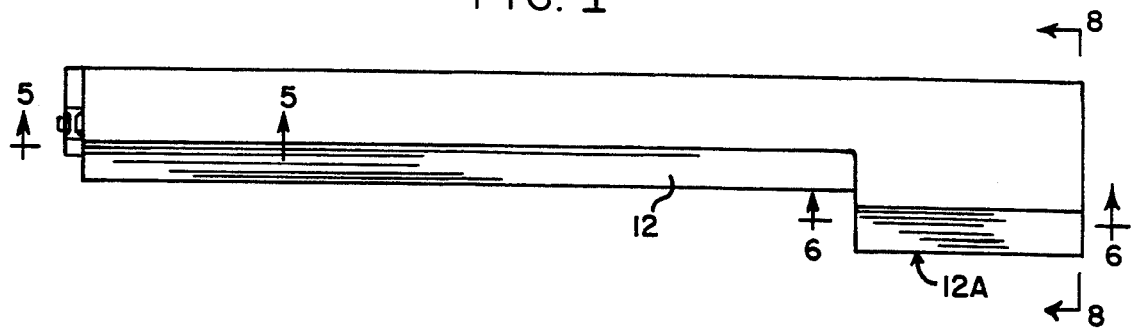
FIG. 1 is a top plan view of roller door apparatus constructed in accordance with the invention.

Reference numeral 10 generally designates roller door apparatus which is constructed in accordance with the principles of this invention. The apparatus 10 comprises a curtain 11 which is unwound from a support roller within a housing 12 to cover a door opening. An electrical drive motor assembly within a portion 12A of the housing 12 controls winding and unwinding of the curtain 11.

In the illustrated apparatus, the roller housing 12 is horizontal and opposite ends thereof are supported on upper ends of side housings 13 and 14 which extend upwardly from a support surface 15, housings 13 and 14 being on the left and right sides of the apparatus as viewed from the front and being referred to herein as left and right housings. In the drawings, the curtain 11 is shown in unwound condition in which an end rail structure 16, secured to the free end thereof, is slightly above the support surface 15. In the wound condition of curtain 11, the end rail structure 16 is positioned just below the roller housing 12. The curtain 11 may preferably be of a suitable strong flexible sheet material, but may be constructed of articulated panels or may otherwise be of sufficient flexibility to be wound and unwound from a drum or roller.

The curtain support roller is identified by reference numeral 18 and is in the form of a cylindrical tube which is supported through a plurality of axially spaced support members 19 on a shaft 20, one of the support members 19 being shown in FIG. 6. Left and right ends of the shaft 20 project from the opposite ends of the tube 19 and are journaled by bearings 21 and 22, which are supported on brackets 23 and 24 on end walls 25 and 26 of the left and right hand housings 13 and 14.

The housings 13 and 14 provide vertical guide slots for receiving and guiding left and right edge portions of the curtain 11 and for receiving and guiding a pair of members 29 and 30 at the opposite ends of the end rail 16, such members 29 and 30 being hereinafter referred to as left and right inserts. A known type of break-out connection is preferably provided between the end rail 16 and the inserts 29 and 30 to allow the end rail 16 and the curtain 11 to be moved out of the way when an excessive force is applied thereto.

Figure 7:
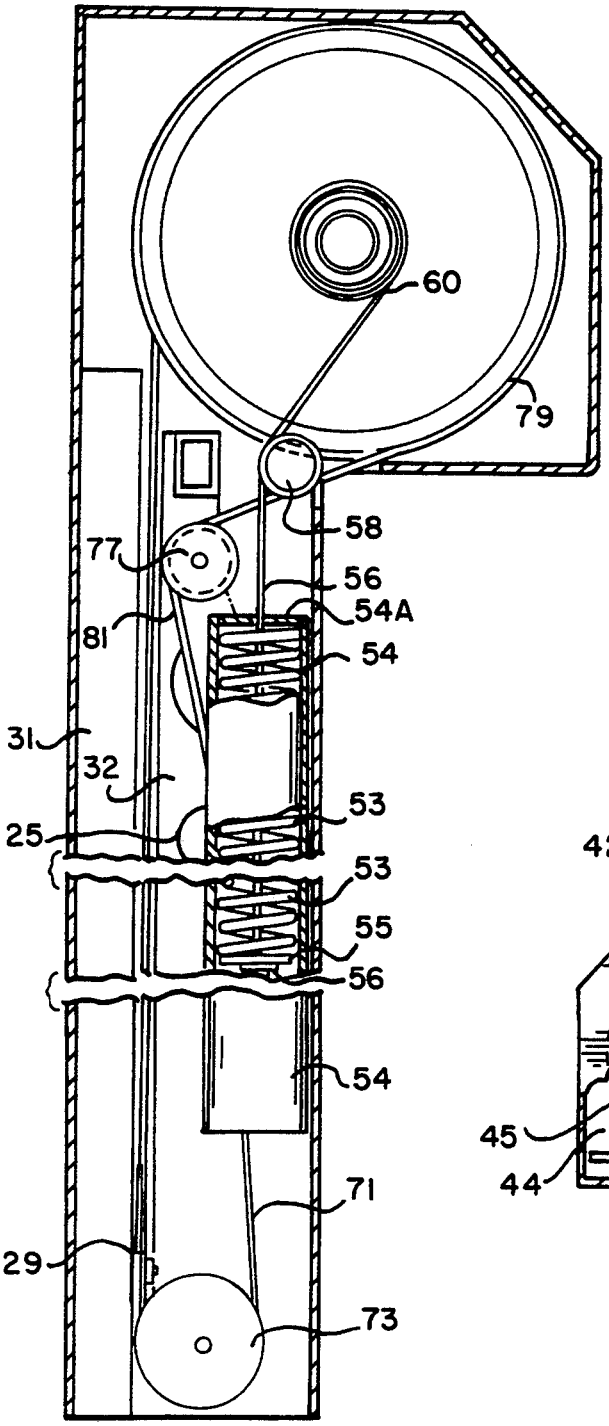
FIG. 7 is an elevational sectional view taken substantially along line 7—7 of FIG. 2, with certain portions broken away.
Figure 8:
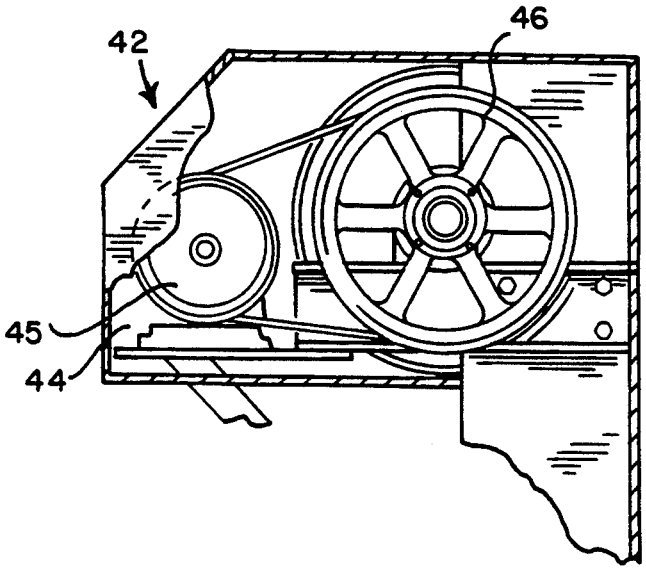
FIG. 8 is a sectional view taken substantially along line 8—8 of FIG. 1.

As is best shown in FIG. 7, the vertical guide slot of the left hand housing 13 is provided between the front and rear surfaces of a pair of rear and front post members 31 and 32, a similar pair of rear and front post members 33 and 34 being provided in the right hand housing 14. The housings 13 and 14 further include rear wall portions 35 and 36, front wall portions 37 and 38 which are parallel to rear wall portions 35 and 36 and angular front wall portions 39 and 40 which extend rearwardly and inwardly from the left and right edges of portions 37 and 38 to the front post members 32 and 34. The configuration of the wall portions of the right housing 14 is best shown in FIG. 9.

Figure 15:
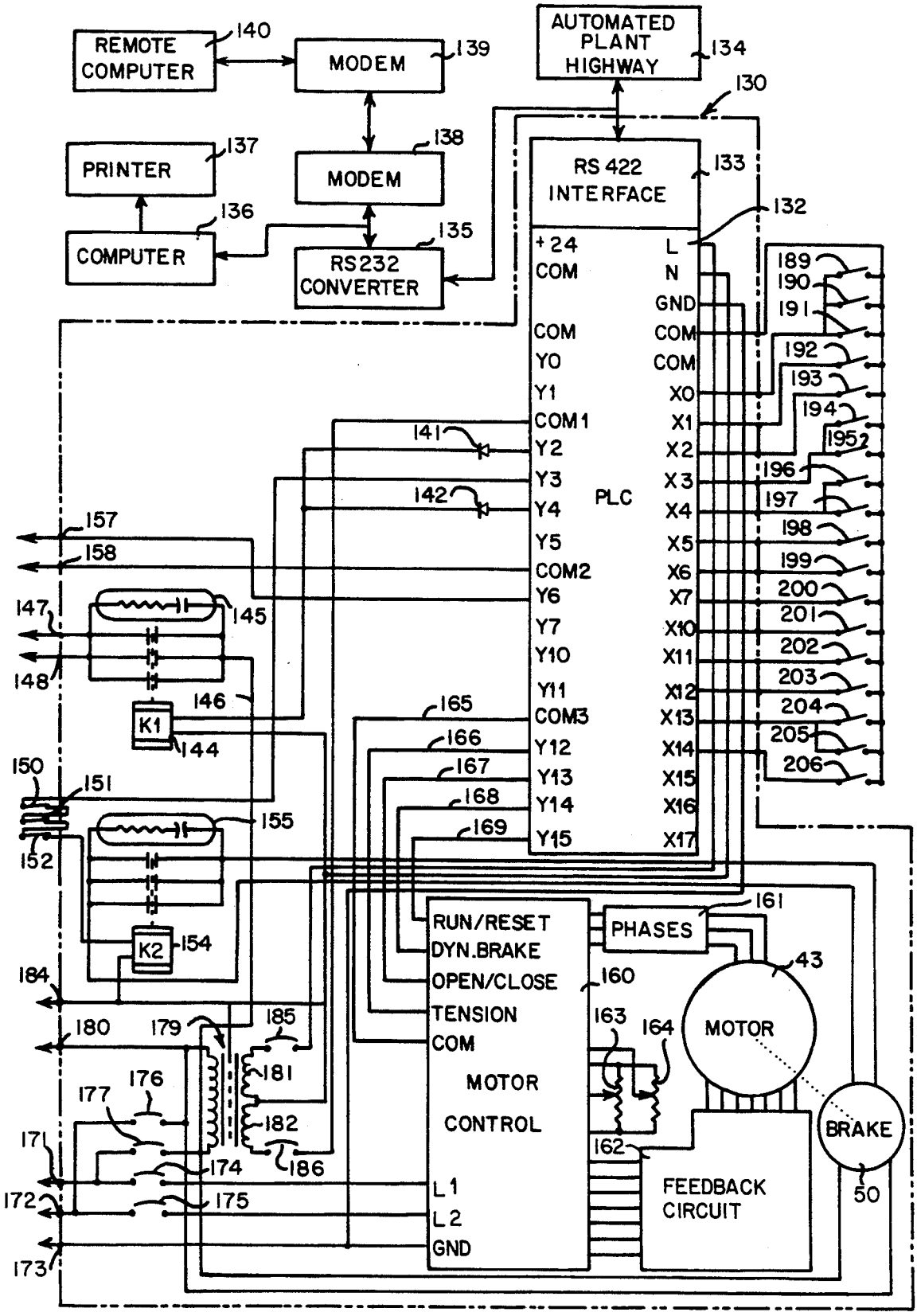
FIG. 15 is a circuit diagram of an electrical control system of the apparatus of FIGS. 1—14.

A drive motor assembly 42 is provided within the housing portion 12A. The illustrated assembly 42 includes a brushless DC servo motor 43 mechanically coupled through a gear box 44 to gear belt drive pulley 45 which is coupled through a gear belt 46 to a pulley 48 on the right end of the roller support shaft 20. An electromechanical brake 50 is provided and is shown located between the motor 43 and the gear box 44, being operative directly on the shaft of the servo motor. The servo motor 43 and the electromechanical brake 50 are controlled through a control system which is shown in FIG. 15 and which is described in detail hereinafter.

The use of the servo motor 43 and electromechanical brake 50 facilitates safe and reliable movement of the curtain 11 at very high speeds without producing excessive stresses in the curtain 11 or other components. The use of the gear belt 46 is an important specific feature in that it is found that the resiliency and damping characteristics inherently provided by a gear belt result in the absorbing of shocks which might otherwise be transmitted to the curtain through the shaft 50 and roller 18 if a chain or other more rigid coupling were provided.

Other features of construction facilitate the achievement of a high speed of operation and the avoidance of excessive stresses. For example, it is found to be very important to minimize the torque required for acceleration and deceleration of the roller 18, so as to allow use of a servo motor of low inertia. In the illustrated type of apparatus in which the curtain is moved vertically, it is desirable to provide a counterbalance for the forces of gravity acting on weight of the curtain 11 and end rail 16. In the apparatus 10, a pair of counterbalancing assemblies which include springs are provided in the left and right housings 13 and 14. The use of springs for counterbalance is in itself advantageous in minimizing inertia.

The spring assemblies of the invention have additional advantages including the achievement of a very accurate counterbalance and in providing a high degree of safety and reliability. As shown in FIG. 7, an assembly in the left housing 13 includes a coiled compression spring 53 which is housed in a vertically extending cylindrical support member 54. The upper end of spring 53 engages an inwardly extending annular flange portion 54A of the member 54 and the lower end of spring 53 engages a washer 55. A counterbalance belt 56 has a lower end secured to a stop member 57 and it extends through the washer 55, thence upwardly through the spring 53, thence over a pulley 58 and thence to a flanged spool 60 on which it is wound, spool 60 being secured to the roller shaft 20. As shown, the direction of winding of the counterbalance belt 56 on the spool 60 is such as to apply a counterbalance torque in a direction opposite that applied by the force of gravity acting on the curtain 11 and on the end rail 16.

An identical counterbalance assembly is provided in the right housing 14 and it includes a spring 63, cylinder 64, counterbalance belt 66 and spool 70 which respectively correspond to the spring 53, cylinder 54, counterbalance belt 56 and spool 60 of the left assembly, other components of the right assembly also being identical to those of the left assembly.

The springs 53 and 63 are preferably of standard forms, each being operative to develop a force which increases substantially linearly with upward deflection of its lower end which is pulled upwardly by the belt 56 or the belt 66. The weight of the suspended portion of the curtain 11 increases linearly with downward movement thereof and since the two movement are proportional, changes in the net torque are minimized. An even more accurate counterbalance is achieved by providing an initial compression of the springs which is such as to develop a torque substantially equal to the torque developed by the weight of the end rail 16 and the curtain when the end rail is in is uppermost position.

By way of example, and not by way of limitation, a construction such as illustrated may be used for a door opening 10 feet high and in which the diameter of the roller 18 may be 12 inches and the diameter of the spools 60 and 70 may be in the same proportion to that of the roller 18 as illustrated. Each of the springs 53 and 63 may have a length in its unstressed condition of 80 inches and each may be compressed about 6 inches when the end rail 16 in its uppermost position, and approximately 40 inches when the lower rail is in its lowermost position.

Thus a construction is provided in which the torque required to move the curtain can be made to be substantially independent of the vertical position of the curtain and, in addition, the inertia of the moving parts is minimized. An additional advantage relates to safety and reliability. Compression springs are inherently reliable, with a low failure rate, and with the construction as illustrated, the springs 53 and 63 are safely enclosed within the cylinders 54 and 64 which are enclosed, in turn, within the housings 13 and 14.

Another feature relates to the provision of a pair of control belts 71 and 72 which are connected to inserts 29 and 30 and which act to insure rapid acceleration of the curtain 11 during an initial portion of its downward movement and which also act to insure rapid deceleration of the curtain 11 during a final portion of its upward movement. Belts 71 and 72 extend from the inserts 29 and 30 down and around a pair of lower idler pulleys 73 and 74, thence upwardly and over a pair of upper idler pulleys 75 and 76, thence about a pair of spring-loaded idler pulleys 77 and 78 and thence to a pair of spools 79 and 80 on the ends of the roller 18. Belts 71 and 72 are wound on the spools 79 and 80 in a direction such as to be wound up on the spools 79 and 80 as the curtain 11 is unwound from the roller 18. The spring-loaded idler pulleys 77 and 78 are parts of standard commercially-available take-up roller assemblies in which they are journaled on the ends of a pair of spring-loaded arms 81 and 82. They apply only a very light force, operating in a conventional manner to take-up slack in the control belts 71 and 72 when they are not active and to prevent the belts from slipping off the pulleys on which they are entrained.

Another important feature of the invention relates to the application of tension to the curtain 11 when in the closed condition as shown. In accordance with this feature, a pair of solenoid-controlled latch mechanisms are provided at opposite ends of the end rail 16. When the end rail 16 and curtain 11 are moved downwardly to the position shown, the end rail 16 is latched against upward movement. Then the servo motor 43 is energized in a direction to pull the upper end of the curtain upwardly and to develop a predetermined high tension in the curtain 11, to resist wind pressures and to minimize oscillatory flapping movements thereof. When it is desired to open the door opening, the servo motor 43 is initially energized in an opposite direction, to reduce the tension in the curtain 11, and then the latch mechanisms are released, through the electrical control system of the invention as hereinafter described.

The latch mechanisms are substantially identical, the mechanism at the right end of the end rail 16 being shown in FIGS. 9, 10, 11 and 12. It includes a latch member 85 which cooperates with a pin 86 carried by the right insert 30 and which is supported by a pin 87 for pivotal movement between a latched position shown in FIG. 11 and an unlatched position shown in FIG. 12. Pin 86 is supported between a pair of upstanding members 88 and 89 and extends horizontally below and in alignment with the right insert 30 and with the pin 86 carried by the right insert 30. The latch member 85 has an upwardly extending arm portion 90 formed to provide cam surface portion 91 which is engaged by the pin 86 when the insert 30 and pin 86 are moved downwardly to the position shown, to momentarily rotate the latch member 85 in a clockwise direction as viewed in FIGS. 11 and 12 and to allow the insert 30 to move to the position shown. The latch member 85 is biased to then rotate in a counter-clockwise direction back to the latching position shown in which a surface portion 92 thereof is faced downwardly in latching engagement with the pin 86. The latch member 85 is also formed to provide a pair of spaced arm portions 93, only one of which appears in FIGS. 11 and 12, which embrace a plunger 95 of a solenoid 96. A pin 97 extends through the end of the plunger 95 and through aligned slots in the spaced arm portions 93. The weight of the arm portions 93 together with that of the plunger 95 serve to bias the latch member in a counter-clockwise direction toward the position shown. To release the latch, the solenoid 96 is energized to move the plunger 95 upwardly and to pivot the latch member to the position shown in FIG. 12.

In accordance with a further feature of the invention, a sensing bar 100 is movably carried on the underside of the end rail 16 to be engaged by any obstruction in the path of movement of the end rail and to be moved upwardly relative to the end rail and to activate an electrical sensor. In one preferred arrangement as depicted in FIGS. 10 and 13, the left and right ends of the sensing bar 100 are carried by left and right support members 101 and 102 which are pivotal about an axis parallel to the bar 100. The right support member 102 is pivotally supported by a pin 103, shown in FIGS. 10 and 13, and it carries a magnet 104 for cooperation with a reed switch 106 carried by the insert 30. Reed switch 106 may be hereinafter referred to as being a right safety switch and senses not only a displacement of the sensing bar relative to the end rail 16, but also movement of the end rail 16 relative to the right insert 30 when, for example, there is a break-out condition of the end rail 16. A similar reed switch 106A is carried by the left insert 29 for cooperation with a magnet 104A carried by a left support member 102A at the left end of the bar 100. As aforementioned, a known type of break-out connection is preferably provided between the end rail 16 and the inserts 29 and 30. When the sensing bar 100 is in the position shown in FIGS. 10 and 13, the magnets 104 and 104A are in axial alignment with and in close proximity to the reed switches 106 and 106A. When an obstruction is engaged, the sensing bar 100 is pivoted relative to the end rail 16, in a clockwise direction as viewed in FIG. 13, to position one or both of the magnets 104 and 104A out of alignment with and away from the respective reed switch 106 or 106A.

To connect the reed switch 106 to electrical control circuitry of the apparatus, it is connected to one end of a cable 107 which extends through the pin 86, which is hollow, and to an end of a flexible cable carrier 108 which is supported by a bracket 109 secured to the insert 30. The opposite end of the cable carrier 108 is supported by a bracket 110 positioned within the right housing 14 at a position midway between the lowermost position of insert 30 as shown and its uppermost position. A similar flexible cable carrier 108A is provided in the left housing 13.

Figure 2:
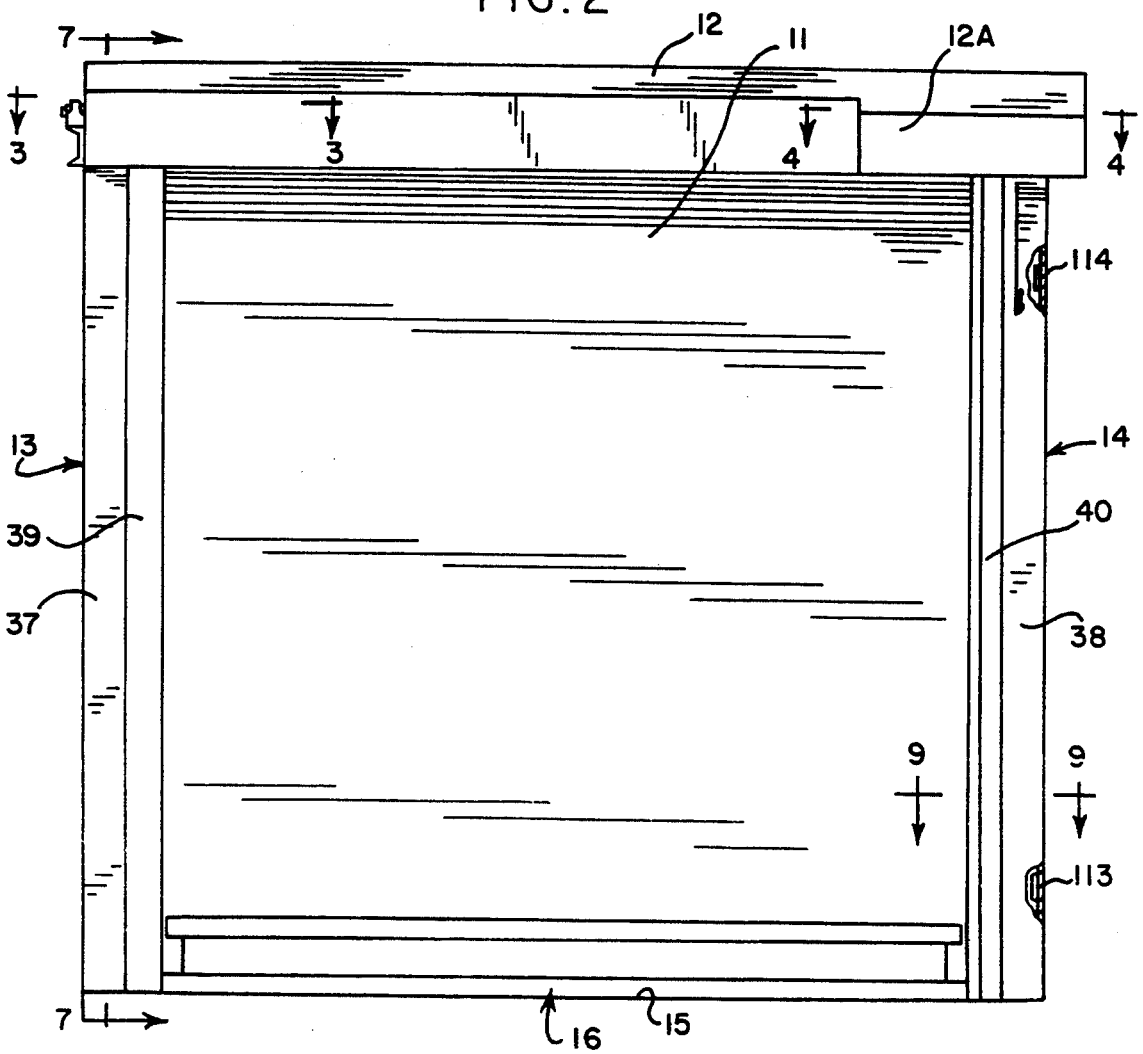
FIG. 2 is a front elevational view of the roller door apparatus of FIG. 1.

For control of deceleration of the curtain 11 as the lower and upper end positions are approached, a magnet 112 is carried at the terminal end of the insert 30, as shown in FIG. 9, for cooperation with reed switches 113 and 114 which are shown in FIG. 2 and which are positioned at certain distances above the lower end position and below the upper end position. It is noteworthy that these switches and all wiring, as well as other components of the apparatus are protectively enclosed within housings, for maximum safety and reliability. It is also noteworthy that additional known types of safety and other features may be readily incorporated in the system. For example, photocell arrangements may preferably be supported in the roller housing 12 or one or both of the left and right housings 13 and 14, for detection of people or objects in the vicinity of the apparatus, and the wiring to such arrangements may be protectively enclosed.

It will be understood that obstruction sensing arrangements differing from that shown in FIGS. 10 and 13 may be used. For example, a sensing bar may be supported for rectilinear movement relative to the end rail 16, rather than for pivotal movement as shown. Such an arrangement is depicted in FIG. 14, in which a main end rail member 116 is formed with a longitudinal passage 117, the passage having a longitudinally extending open slot 118 of reduced width along the lower edge of the member 116. A sensing bar 120 is formed with an upper generally T-shaped portion 121 to fit in the passage 117 but to allow upward displacement relative to the end rail member 116. Bar 120 carries a magnet 122 for cooperation with the reed switch 106 and a similar magnet at its opposite end for cooperation with a reed switch which is like the reed switch 106 and which is connected to control circuitry through a cable arrangement in the left housing 13 like that used for the reed switch 106.

FIG. 15 shows a schematic diagram of an electrical drive and control system 130 which is indicated in broken lines and as including the motor 43 and electromechanical brake 50 and a programmable logic control (PLC) 132. The system 130 may, for example, be physically located within the drive motor housing 12A.

FIG. 15 also shows connections which may be made to the system 130 for monitoring, control and servicing purposes. As shown, an RS422 interface 133 is connected to the PLC 132 and is usable to apply control signals to the PLC 132 and to transmit control and/or status signals to various types of external equipment. For example, the RS422 interface may be connected to a bus or an automated plant highway 134 as shown, and/or it may be connected to an RS232 converter 135, shown connected to a local computer 136 which is connected to a printer 137. The RS232 converter 135 is also shown connected to a modem 138 which may be coupled through a direct telephone line or through a telephone system to a second modem 139 which is connected to a remote computer 140. Either the local computer 136 or the remote computer 140 may be used to supply control signals to the PLC 132, to obtain information as to the status of various input and output ports of the PLC 132, and to perform trouble shooting, servicing and reprogramming operations as may be necessary or desirable. Thus a high degree of versatility and adaptability is provided.

The illustrated PLC 132 has sixteen input terminals or pins X0–X7 and X10–X17 and fourteen output terminals or pins Y0–Y7 and Y10–Y15. Input ports X0–X7 and X10–X14 and a common pin are connected to various switches of the apparatus 10, as will be described.

Output ports Y2 and Y4 are connected through diodes 141 and 142 to a relay 144 which controls the solenoids 96 and 96A of the right and left latches. Three normally open contacts thereof are connected in parallel with an arc suppressor 145 and between a supply line 146 and terminals 147 and 148 which are connected to the solenoids 96 and 96A for energization thereof to release the latches when the relay 144 is energized.

Output port Y3 is connected through three normally closed switches 150, 151 and 152 to a relay 154 which controls operation of the electromechanical brake 50. The relay 154 has three normally open contacts which are connected in parallel with an arc suppressor 155 and to a pair of control terminals of the brake 50, brake 50 being disengaged when the relay 154 is energized. The normally closed switches 150 and 151 are parts of the right and left reed switches 106 and 106A and are opened in response to sensing of an obstruction, or in response to a break-out condition. The normally closed switch 152 is part of an emergency stop switch.

Output port Y6 together with a common terminal are connected to terminals 157 and 158 which are optionally usable in interlocking the operation of two roller doors which may be installed in tandem in a cold storage plant, for example, in a manner such as to allow opening of only one door at any one time to restrict air flow.

Output ports Y12–Y15 are connected to a motor control 160 of a type known in the art. Motor control 160 has terminals connected through a three phase coupling 161 to the brushless motor 43 and has additional terminals connected to the output of a feedback circuit 162 which has inputs connected to the motor 43. The motor control 160 functions as a commutator to cause current to flow to or from windings of the brushless motor 43 in the proper phase for drive in either direction and for dynamic braking operations. It responds rapidly to signals from the feedback circuit 162 to obtain responsive and accurate control of speed and of drive and braking torques. As shown diagrammatically, a pair of potentiometers 163 and 164 are associated with the motor control for respectively adjusting the closing and opening speeds.

A "COM" terminal of the motor control 160 is connected through a line 165 to a "COM3" terminal of the PLC 132 which controls connection of that terminal to the Y12–Y15 terminals. A "TENSION" terminal of the motor control 160 is connected through a line 166 to the Y12 terminal of the PLC 132 for control of torque when applying tension to the curtain when the end rail is latched in the closed position; an "OPEN/CLOSE" terminal is connected through a line 167 to the Y13 terminal for control of the direction of rotation of the motor 43; a "DYN.BRAKE" terminal is connected to the Y14 terminal for control of a dynamic braking operation; and a "RUN/RESET" terminal is connected to the Y15 terminal for control of energization and deenergization of the motor 43.

The illustrated apparatus is operative from a three line 230 volt source which is connected to terminals 171, 172 and 173, terminals 171 and 172 being connected through circuit breaker contacts 174 and 175 to L1 and L2 terminals of motor control 160 and terminal 173 being connected to ground terminals of the motor control 160 and of the PLC 132. Terminals 171 and 172 are also connected through circuit breaker contacts 176 and 177 to a primary winding 178 of an isolation and step-down transformer 179 and also to a return terminal 180 and the supply line 146 for the latch-control solenoids 96 and **96*a*. The transformer 179 has a 115 volt secondary winding 181 and a 24 volt secondary winding 182 both connected to a neutral terminal of the PLC 132, to the relays 144 and 154 and to a terminal 184 for connection to photo eyes or other components requiring 115 volts for operation. Winding 181 is connected through a circuit breaker contact 185 to a line voltage input terminal of the PLC 132 and 24 volt winding 182 is connected through a circuit breaker contact 186 to a "COM" terminal of the PLC 132**.

The input terminals X0–X14 of the PLC 132 are connected to switch contacts which are associated with various sensing devices and control switches, all such contacts being connected to a "COM" or common terminal of the PLC 132.

Terminal X0 is connected to a contact 189 of an emergency stop switch and to contacts 190 and 191 of the left and right reed switches 106A and 106.

Terminal X1 is connected to a manual close contact 192 and terminal X2 is connected to a manual open contact 193.

Terminal X3 is connected to contacts 194 and 195 of induction loop sensing apparatus installed in the floor for signalling the presence of a body in proximity to the door apparats.

Terminal X4 is connected to contacts 196 and 197 which are connected to photo sensor devices operative to detect any body in the path of movement of the curtain.

Terminal X5 is connected to an alternative open command contact 198 and terminal X6 is connected to an alternative open limit switch contact 199. These are usable to allow the curtain to be opened to a height of less than the full available height, for example to a height of 8 feet when the full available height is 16 feet.

Terminal X7 is connected to a contact 200 of the switch 114 which senses the approach of the fully open condition of the curtain 11.

Terminal X10 is connected to a contact 201 of the switch 113 which senses the approach of the fully closed condition of the curtain 11.

Terminal X11 is connected to a contact 202 of a door latch switch associated with the left latch mechanism and terminal X12 is connected to a contact 203 of a door latch switch associated with the right latch mechanism.

Terminal X13 is connected to contacts 204 and of manually operable toggle switches such as may be operable by pulling on a rope.

Terminal X14 is connected to a contact 206 of an interlock switch usable, for example, when two doors are operable in tandem.

The PLC 132 is programmed for operation of the door apparatus in accordance with the conditions of the various switches connected to the X0–X14 terminals and in accordance with the condition of internal logic circuits which simulate the operation of relays and timers in a manner known in the art.

A ladder diagram of a type of program usable in operation of the PLC 132 is provided in Appendix A and contains explanatory notes as well as notations for two commercially available types of programmable logic controls, one being a Mitsubishi Type FX030 and the other being an Omron Type CK28. Notations for the Mitsubishi Type FX030 are provided above certain horizontal lines of the ladder diagram while those for the Omron Type CK28 are provided below such horizontal lines. Sequence line numbers are indicated along the left of the diagram and are used for reference in the following explanations of operations performed. In the diagram, M0–M34 refer to relays simulated by the PLC 132; X0–X7 and X10–X14 refer to inputs connected to the various contacts as described above and Y2, Y3, Y4, Y6 and Y12–Y15 refer to the various outputs described above. Timers are indicated by references such as T32. It is noted that "K20" appears above the reference to the T32 relay at the right of line 9 of the diagram, the timing duration being indicated by "20"in the case of the Mitsubishi type of PLC, as 20 times 10 or 200 milliseconds, a high speed timing of 10 milliseconds per unit being set at line 0 of the diagram.

One illustrative sequence of operations starts at line 159. In a down condition of the curtain 11, it is under tension, the motor 43 having been energized to pull the upper end of the curtain upwardly after latching of the end rail and after engaging the brake 50. In this condition, the open/close input of the motor control has been changed to be set for a closing direction of movement and a relay M13 is energized. When in this condition and in response to closing of a contact of a master open relay MO, which may occur in response to operation of a manual switch for example, a relay M15 is energized and held energized by a contact thereof as indicated between lines 159 and 164.

As indicated at line 164 a contact of the relay M15 initiates operation of three timers K50, K20 and K25, having respective time-out durations of 500, 200 and 250 milliseconds. Line 174 shows the energization of a relay 29 which has a contact effective to cause energization of the relay 154 and to cause release of the brake 50. Line 177 shows the energization of a relay M28 for a certain time period extending from 200 milliseconds to 250 milliseconds after energization of relay M15. Referring to line 183, relay M28 when energized has a contact which effects the immediate energization of motor 43 (see line 138, Y15 controls running of the motor) in a downward direction but only momentarily because as indicated at line 183 another contact of relay M28 effects energization of a relay M26 and a contact of relay M26 causes the motor control to be set for movement in an upward or opening direction. Although only momentary, the downward movement is sufficient to release tension in the curtain, prior to release of the latches which occurs from development of an output at output terminal Y4 to energize relay and release the solenoids 96 and 96A.

Accordingly, a curtain-opening sequence occurs in which the brake 50 is released, the motor 43 is momentarily driven in a downward or closing direction to release tension in the curtain 11 and the motor 43 is then driven in an upward direction, after release of the latches.

Upward movement of the curtain 11 continues until the end rail reaches a position approaching the upper limit of travel whereupon the dynamic brake is operated under control of the output terminal Y14 and the electromechanical brake 50 is operated under control of the relay 154 through the output terminal Y3. It is noteworthy that signals for operation of both brakes may be applied simultaneously, but the timing may be changed in accordance with the performance characteristics of particular drives and brakes and to obtain high speed operation without excessive stresses.

In a downward closing operation, there is no need for the above describe tension release operation. However, after the curtain is moved to the downward position and the end rail 16 is latched, the direction of rotation of the motor 43 is reversed and it is then energized until a certain torque is developed and until the curtain is thereby tensioned to a predetermined extent. This operation is depicted at lines 119 to 156 and ends with the brake 50 in an engaged condition to maintain tension in the curtain. It will be understood that the motor control 160 is adjustable to obtain the desired tension in the curtain when it is in the latched condition.

Many safety features are incorporated in the system as illustrated, for example for automatic opening of the curtain in response to a break-out condition or the sensing of an obstruction. The system is highly versatile, particularly in that the PLC 132 may be programmed as may be desirable to meet the needs of a particular user of the door apparatus.

It will be understood that modifications and variations may be effected without departing from the spirit and scope of the novel concepts of this invention

What is claimed is:

1. Door apparatus comprising: a roller, means journaling the roller for reversible rotation about a central longitudinal roller axis, an end rail for reciprocable movement in a linear path between a first position in adjacent relation to the roller and a second position away from the roller, a flexible curtain for closing a door opening in the second position of the end rail and having one end secured to the end rail and having an opposite end portion secured to the roller to be wound on the roller during movement of the end rail from the second position to the first position and to be unwound from the roller during movement of the end rail from the first position to the second position, a reversible, variable-speed electric motor drive coupled to the roller and operable in a servo configuration, and also operable for dynamic braking of the roller, and a solid state electrical controller for varying the speed of the motor drive during each movement of the end rail in either direction for rapid acceleration of the curtain to a high speed during an initial portion of each movement and for control of deceleration of the curtain to zero velocity during a final portion of each movement, the solid state controller also comprising means for controlling dynamic braking of the electric motor drive for control of the deceleration.

2. Apparatus as defined in claim 1, wherein the apparatus further comprises an electromechanical brake associated with the drive, the electrical controller including means for controlling the electromechanical brake for additional control of the deceleration.

3. Apparatus as defined in claim 1, wherein the electrical controller comprises sensing means for sensing movement of the end rail through positions approaching the first and second positions for developing corresponding electrical approach signals, and means responsive to the approach signals for control of the deceleration of the curtain means to zero velocity during a final portion of each movement.

4. Apparatus as defined in claim 1, further including flexible elongated control elements connected to the end rail and coupled to the roller for applying an accelerating force to the curtain during acceleration away from the first position of the curtain and for applying a decelerating force to the curtain during deceleration to the first position.

5. Apparatus as defined in claim 4, further comprising a pair of pulleys for cooperation with the flexible elongated control elements and journaled on an axis positioned farther away from the roller than the second position of the end rail.

6. Apparatus as defined in claim 5, further comprising a pair of spools on opposite ends of the roller with end portions of the flexible elongated control elements being wound and unwound from the pair of spools during rotation of the roller in opposite respective directions.

7. Apparatus as defined in claim 1, wherein the roller axis is horizontal and wherein the first position of the end rail is above the second position of the end rail means, the apparatus further comprising counterbalancing means for acting on the roller to apply a counterbalance torque in opposition to a torque resulting from gravitational forces applied by the curtain and the end rail.

8. Apparatus as defined in claim 7, wherein the counterbalancing means comprises spools secured to the roller, elongated flexible means having one end portion secured to and wound on the spools, and coiled springs coupled to an opposite end of the elongated flexible means to apply a linear force thereto and to thereby apply the counterbalance torque to the roller.

9. Apparatus as defined in claim 1, wherein the electrical drive includes a servo motor having a continuously varying range of available speeds.

10. Apparatus as defined in claim 9, wherein the electrical controller includes a programmable logic control for control of the electrical drive.

11. Apparatus as defined in claim 1, including a motor control controlled by feedback from the servo motor for control of speed and acceleration.

12. Apparatus as defined in claim 1, wherein the speed of the flexible curtain is controlled by the combination of a servo motor, motor controller, and a programmable logic controller.

13. Door apparatus comprising: a roller, means journaling the roller for reversible rotation about a central longitudinal roller axis, an end rail for reciprocable movement in a linear path between a first position in adjacent relation to the roller and a second position away from the roller, a flexible curtain for closing a door opening in the second position of the end rail and having one end secured to the end rail and having an opposite end portion secured to the roller to be wound on the roller during movement of the end rail from the second position to the first position and to be unwound from the roller during movement of the end rail from the first position to the second position, a reversible, variable-speed electric motor drive coupled to the roller and operable in a servo configuration, a solid state electrical controller for varying the speed of the motor drive during each movement of the end rail in either direction for rapid acceleration of the curtain to a high speed during an initial portion of each movement and for control of deceleration of the curtain to zero velocity during a final portion of each movement, and further including releasable latch means for latching the end rail in the second position, the electrical controller controlling the electric motor drive to rotate the roller in a direction to apply tension to the curtain after actuation of the releasable latch means to the latching condition.

14. Apparatus as defined in claim 13, wherein the releasable latch means comprise a pair of latches, each operating at opposite ends of the end rail.

15. A door apparatus comprising: a roller, means journaling the roller for reversible rotation about a central longitudinal roller axis, an end rail for reciprocable movement in a linear path between a first position in adjacent relation to the roller and a second position away from the roller, a flexible curtain for closing a door opening in the second position of the end rail and having one end secured to the end rail and having an opposite end portion secured to the roller to be wound on the roller during movement of the end rail from the second position to the first position and to be unwound from the roller during movement of the end rail from the first position to the second position, a reversible variable-speed electric motor drive coupled to the roller and operable in a servo configuration and also operable for dynamic braking of the roller, and a solid state electrical controller for varying the speed of the motor drive during each movement of the end rail in either direction, the solid state controller also comprising means for controlling dynamic braking of the electric motor drive for control of the deceleration.

* * * * *